US010405629B2

(12) United States Patent
Trelles-Tvede

(10) Patent No.: US 10,405,629 B2
(45) Date of Patent: Sep. 10, 2019

(54) HAIR STYLING UTENSIL

(71) Applicant: Invisibobble GmbH, Munich (DE)

(72) Inventor: Sophie Trelles-Tvede, Munich (DE)

(73) Assignee: invisibobble GmbH (DE)

( * ) Notice: Subject to any disclaimer, the term of this patent is extended or adjusted under 35 U.S.C. 154(b) by 233 days.

(21) Appl. No.: 15/062,040

(22) Filed: Mar. 4, 2016

(65) Prior Publication Data

US 2017/0049208 A1 Feb. 23, 2017

(30) Foreign Application Priority Data

Aug. 19, 2015 (DE) ..... 10 2015 215 832

(51) Int. Cl.
*A45D 8/38* (2006.01)
*A45D 8/34* (2006.01)

(52) U.S. Cl.
CPC ..... *A45D 8/38* (2013.01); *A45D 8/34* (2013.01)

(58) Field of Classification Search
CPC ..... A45D 8/34; A45D 8/36; A45D 8/38; A44C 5/00; A44C 5/0053; A44C 5/0069; A44C 5/0076; A44C 5/04; A44C 9/00; A44C 9/02; Y10T 24/1408
USPC ..... 132/273, 277
See application file for complete search history.

(56) References Cited

U.S. PATENT DOCUMENTS

| | | | | |
|---|---|---|---|---|
| 2,924,228 A | | 2/1960 | McGee | |
| D300,675 S | * | 4/1989 | Sacher | D11/3 |
| 5,878,755 A | | 3/1999 | Crabtree et al. | |
| D428,530 S | * | 7/2000 | Dorsey | D28/41 |
| 7,305,996 B2 | * | 12/2007 | Kraft | A45D 8/34 132/273 |
| 2009/0255295 A1 | * | 10/2009 | Lane | A44C 5/0053 63/3.1 |
| 2009/0301510 A1 | * | 12/2009 | Hsu | A45D 8/00 132/273 |
| 2012/0118317 A1 | * | 5/2012 | Payne | A45D 8/00 132/275 |
| 2014/0096788 A1 | * | 4/2014 | Krasniansky | A45D 8/34 132/273 |

FOREIGN PATENT DOCUMENTS

| | | |
|---|---|---|
| CN | 201197458 Y | 2/2009 |
| CN | 201267262 Y | 7/2009 |
| CN | 202396348 U | 8/2012 |
| TW | M398815 U | 3/2011 |
| TW | M442070 U | 12/2012 |

OTHER PUBLICATIONS

European Search Report for EP 16184432.9 dated Dec. 21, 2016.
First German Office Action dated Apr. 15, 2016 for Application No. 102015215832.2.
Russian Office Action for RU 2016133955/12.
English abstract for CN-202396348.
English abstract for CN-201197458.
Chinese Office Action dated Oct. 31, 2018 for Application No. 201610698359.X.

* cited by examiner

*Primary Examiner* — Wade Miles
*Assistant Examiner* — Jennifer F Gill
(74) *Attorney, Agent, or Firm* — Fishman Stewart PLLC

(57) ABSTRACT

A hair styling utensil may include a continuous helix that runs in a circular manner. The continuous helix may include an elastic material. The continuous helix may have a total of six to eight turns. Each turn may adjoin an adjacent turn on an inner area.

13 Claims, 1 Drawing Sheet

HAIR STYLING UTENSIL

CROSS-REFERENCE TO RELATED APPLICATIONS

This application claims priority to German Patent Application No. 10 2015 215 832.2, filed Aug. 19, 2015, the contents of which are hereby incorporated by reference in their entirety.

TECHNICAL FIELD

The instant invention relates to a hair styling utensil.

BACKGROUND

To date, either hair clips, barrettes or hair ties, which are partially difficult to insert and which, when worn for a longer period of time, could possibly lead to headaches due to pulling the hair, were available for creating pinned hairdos, in particular pinned-up hairdos. In addition, the creation of particularly fashionable hairdos was not possible or was an extremely complex matter when using such hair ties or barrettes, respectively, or hair clips.

SUMMARY

The instant invention thus deals with the problem of specifying a hair styling utensil, which is characterized in particular by a simple handling, a high wearing comfort and a high flexibility with regard to possible hairdos, which can be created.

This problem is solved according to the invention by means of the subject matter of the independent claim(s). Advantageous embodiments are the subject matter of the dependent claim.

The instant invention is based on the general idea of creating a novel hair styling utensil, which cannot only be inserted into the hair in a comparatively simple manner, but which additionally also provides for a long-lasting fixation of the hair, which is styled therewith, without resulting in headaches, for example caused by undesired pulling of the hair, when wearing it for a longer period of time. The hair styling utensil according to the invention thereby has a continuous helix, which runs in a circular manner, consisting of an elastic material, wherein said continuous helix has a total of six to eight, preferably seven turns, which adjoin one another on an inner area. By means of the hair styling utensil, which, according to the invention has six to eight and in particular preferably exactly seven turns, an extremely simple application can be attained, in response to which the hair styling utensil needs to only be attached and does not need to be integrated, as has been the case to date. Due to the flower-shaped arrangement or the virtually radial orientation of the individual seven turns of the continuous helix, respectively, as well as due to the pressure caused by the turns, which adjoin one another closely, in the inner areas thereof, the hair styling utensil according to the invention grips the hair tightly and thus provides a stable hold, without having to fixedly integrate it into the hair. In particular, so-called "pinned-up hairdos" can be created in a comparatively simple and furthermore in an extremely flexible manner by means of the hair styling utensil according to the invention. Due to the elasticity of the continuous helix, it is thereby furthermore possible to fix strands of hair comprising different thicknesses by means of the hair styling utensil.

In the case of an advantageous further development of the solution according to the invention, the hair styling utensil has a clear inner diameter $d_i$ of approx. 0.5 cm in the unstressed state. By means of this indication of size, it already becomes clear, how small the hair styling utensil according to the invention is, so that the latter can also be stored and brought along easily, for example in a trouser pocket, when not in use.

Advantageously, one turn of the continuous helix has a diameter $d_{Ea}$ of approx. 1.0 cm. Diverse tests showed that specifically this diameter provides for the fixation of the hair by means of the hair styling utensil according to the invention in a particularly simple manner on the one hand and in a particularly flexible manner on the other hand.

In the case of a further advantageous embodiment of the solution according to the invention, the hair styling utensil has an outer diameter $d_a$ of approx. 2.5 cm. As a comparison, we give the example of a 2 Euro coin, which also has an outer diameter of approx. 2.5 cm, from which it becomes clear again, how small the hair styling utensil according to the invention is and that it can thus also be brought along otherwise in a space-saving manner, in particular in a pocket, for example when not in use.

In the case of a further advantageous embodiment of the solution according to the invention, the elastic material of the continuous helix is made of an elastic plastic, in particular of polyurethane. Polyurethanes are plastics or plastic resins, respectively. By using polyurethane, a surface, which is closed per se, can be attained, which prevents an absorption or adsorption, respectively, of dirt or bacteria and which thus provides a high hygiene standard. Polyurethane is furthermore considered to be non-allergenic, so that, typically, health impairments are not to be expected. Due to the water-resistant and sweat-resistant effect of polyurethane, the hair styling utensil according to the invention can also be used without any problems when doing sports, whereby it can demonstrate its large advantages, in particular under high stresses. In particular, this also includes that, in spite of the strong hold of the hair by means of the hair styling utensil, imprints do not remain on the hair after wearing.

In the case of a further advantageous embodiment of the hair styling utensil according to the invention, the elastic material of the continuous helix has a slip-resistant surface that has a good grip, in particular a slip-resistant coating. On the one hand, an easy yet reliable gripping and thus an easier handling of the hair styling utensil according to the invention can be attained through this, and, on the other hand, a reliable holding of the hair, which is fixed therewith.

The thickness or a diameter, respectively, of the spring element, which forms the continuous helix, is thereby approx. 0.9 cm, which turned out to be particularly advantageous. Advantageously, a beginning and an end of the continuous helix are fused to one another. This is due to a special production process, in the case of which the helix is initially produced in a type of continuous turn or continuous helix, respectively, and is then trimmed according to the preferably seven turns, which are required for the hair styling utensil according to the invention. Occasionally, a slight seam can be perceived optically. However, it goes without saying that purely theoretically, it is also possible that a beginning and an end of the continuous helix are connected to one another via a seam, which is surface-aligned and which can thus not be perceived haptically and/or optically, so that the beginning and the end of the continuous helix are not visible.

In the case of an alternative embodiment of the solution according to the invention, the continuous helix is embodied in one piece, wherein a beginning and an end of the continuous helix merge into one another seamlessly. This can be attained, for example, by means of a corresponding plastic injection mold.

Further important features and advantages of the invention follow from the subclaims, from the drawings and from the corresponding figure description by means of the drawings.

It goes without saying that the features mentioned above and the features, which will be explained below, cannot only be used in the respectively specified combination, but also in other combinations or alone, without leaving the scope of the instant invention.

Preferred exemplary embodiments of the invention are illustrated in the drawings and will be specified in more detail in the description below, wherein the same reference numerals refer to the same or to similar or to functionally equal components.

BRIEF DESCRIPTION OF THE DRAWINGS

In each case schematically.

DETAILED DESCRIPTION

Figure 1:
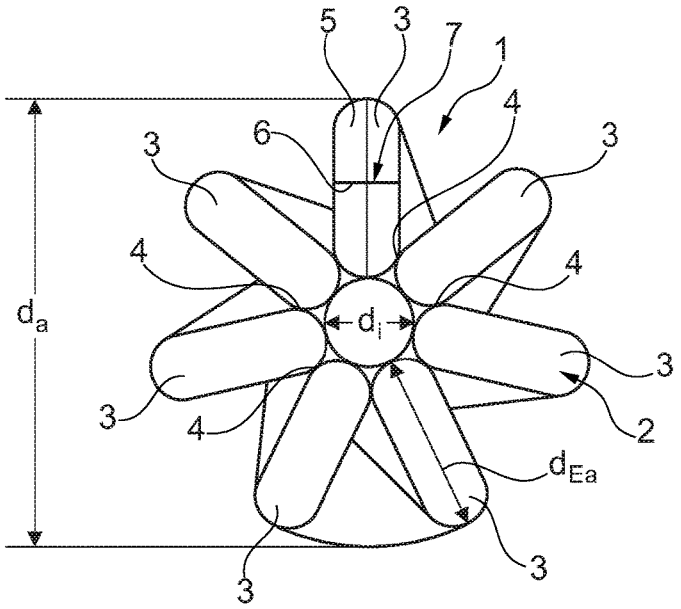
FIG. 1 shows a frontal view onto a hair styling utensil according to the invention.
Figure 2:
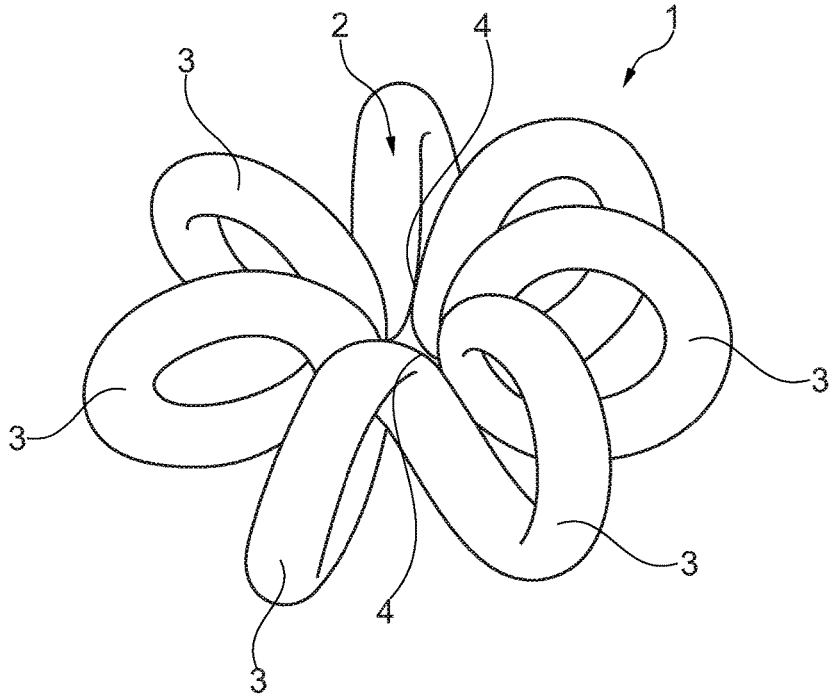
FIG. 2 shows a diagonal view onto the hair styling utensil.

According to FIGS. 1 and 2, a hair styling utensil 1 according to the invention has a continuous helix 2, which runs in a circular manner, consisting of an elastic material, wherein the continuous helix 2 has a total of seven turns 3, which adjoin one another in an inner area 4. Purely theoretically, the hair styling utensil 1 according to the invention can also have only six or even eight such turns 3, wherein a particularly advantageous creation of the hairdos resulted in the case of exactly seven such turns 3, because the required tension is still present in the hair for fixing in the case of seven turns 3, while an elasticity, which also makes it possible to mold the hair, is at hand. The continuous helix 2 is formed by a spring element, which is wound in a screw thread-shaped manner and which has a diameter d of 0.9 cm, for example.

The hair styling utensil 1 according to the invention has a clear inner diameter $d_i$ of approx. 0.5 cm and an outer diameter $d_a$ of approx. 2.5 cm, so that the hair styling utensil 1, which is illustrated according to FIG. 1, substantially only has the size of a 2 Euro coin. A turn 3 of the continuous helix 2 has a diameter $d_{Ea}$ of approx. 1.0 cm.

The elastic material, which is used for the continuous helix 2, can be made in particular of an elastic plastic, for example of polyurethane, and is thus not only elastic for a long time, but also has no health risks and is in particular water-repellent and sweat-repellent, whereby the hair styling utensil 1 according to the invention can even be used without any problems when doing sports and in particular also while swimming.

In addition, the elastic material of the continuous helix 2 can have a slip-resistant surface that has a good grip, in particular a slip-resistant coating, which, on the one hand, facilitate the comprehending and the handling of the hair styling utensil 1 according to the invention and which, on the other hand, fix the hair reliably during the fixing process.

Typically, the continuous helix 2 has a beginning 5 and an end 6, which are fused to one another via a seam 7 and which are thus fixed to one another. The seam 7 can thereby be perceived haptically, in particular in the manner of a small annular bead, wherein it goes without saying that it is also possible as an alternative that the beginning 5 and the end 6 of the continuous helix 2 are connected to one another via a surface-aligned and thus haptically non-perceivable seam 7, so that, in this case, the beginning 5 and the end 6 of the continuous helix 2 cannot be determined at all. Again as an alternative, it is also possible that the beginning 5 and the end 6 merge into one another seamlessly, wherein, in this case, the continuous helix 2 is produced in a specially molded plastic injection mold, for example by means of an injection molding process.

The following advantages can be realized by means of the hair styling utensil 1 according to the invention, in particular as compared to common hair ties or barrettes:

- It does not leave behind any imprints in the hair after being worn,
- it provides for a revolutionary styling of even sophisticated and extraordinary hairdos,
- it prevents split ends and hair breakage,
- it is water-repellent and sweat-repellent and can thus be used in virtually all situations in life,
- it avoids headaches, because it does not transfer any pulling forces of the hair to the scalp,
- it is anti-allergic,
- it is suitable for any type of hair,
- it provides an extraordinarily strong hold, due to the elasticity of the material, it can be used without any problems for strands of hair comprising different thicknesses,
- it ensures a significantly longer life expectancy,
- it prevents tangles and pulled-out hair.

Compared to current hair ties, the hair styling utensil 1 according to the invention also has a significantly longer life expectancy, wherein, due to the use of polyurethane, it is also possible to attain a memory effect, so that, in the case of a stretched continuous helix 2, the hair styling utensil 1 only needs to be placed onto a heater, for example, so as to be capable of being returned into its original state due to the heat.

Due to the use of polyurethane, the hair styling utensil 1 according to the invention is furthermore particularly hygienic, because it does not absorb dirt or bacteria. The hair styling utensil 1 according to the invention can be cleaned using virtually all soaps or household cleaners, respectively, whereby it can be cleaned easily even after being soiled significantly.

Extremely spectacular hairdos can be created for the first time in a comparatively simple yet permanent manner by means of the hair styling utensil according to the invention. The special effect when creating the hairdos lies in the total of preferably only seven turns 3 of the continuous helix 2, which touch one another, that is, which adjoin one another, on the inner area 4.

Hairdos, which could not be created or which could only be created in a comparatively complicated manner by means of common hair clips or hair ties—also using significantly more hair clips or ties—can now also be created for the first time by means of the hair styling utensil according to the invention. Extraordinary hairdos can also be created quickly and simply by means of the hair styling utensil according to the invention.

The invention claimed is:

1. A hair tying utensil, comprising:

a continuous helix, which runs in a circular manner, the continuous helix including an elastic material with a slip-resistant coating, wherein the continuous helix has a total of six to eight turns, each of which is in direct contact with an adjacent turn on an inner area when the utensil is in an unstressed state, each turn of the continuous helix having a diameter of approximately 1.0 cm, and wherein the continuous helix has an inner diameter of approximately 0.5 cm and an outer diameter of approximately 2.5 cm.

2. The hair tying utensil according to claim 1, wherein the elastic material of the continuous helix is made of an elastic plastic.

3. The hair tying utensil according to claim 2, wherein the elastic material of the continuous helix is made of polyurethane.

4. The hair tying utensil according to claim 1, wherein a beginning and an end of the continuous helix are fused to one another.

5. The hair tying utensil according to claim 1, wherein a beginning and an end of the continuous helix are connected to one another via a seam, which is surface-aligned such that the seam is substantially haptically unperceivable.

6. The hair tying utensil according to claim 5, wherein the elastic material of the continuous helix is made of polyurethane.

7. The hair tying utensil according to claim 1, wherein a beginning and an end of the continuous helix merge into one another seamlessly.

8. The hair tying utensil according to claim 3, wherein a beginning and an end of the continuous helix are fused to one another.

9. The hair tying utensil according to claim 8, wherein the beginning and the end of the continuous helix are connected to one another via a surface-aligned seam.

10. A hair tying utensil comprising a continuous helix running in a circular manner and having an inner diameter of approximately 0.5 cm, an outer diameter of approximately 2.5 cm, and seven turns, each of which is in direct contact with an adjacent turn on an inner area when the utensil is in an unstressed state and each of which has a diameter of approximately 1.0 cm, the continuous helix including a slip-resistant coating, wherein a beginning and an end of the continuous helix is at least one of:

fused to one another;

connected to one another via a surface-aligned seam; and merge into one another seamlessly.

11. The hair tying utensil according to claim 10, wherein the continuous helix includes an elastic material.

12. The hair tying utensil according to claim 11, wherein the elastic material of the continuous helix is an elastic plastic.

13. The hair tying utensil according to claim 12, wherein the elastic material of the continuous helix is made of polyurethane.

* * * * *